US007806284B2

(12) United States Patent
Mangano

(10) Patent No.: US 7,806,284 B2
(45) Date of Patent: Oct. 5, 2010

(54) STACKING TOWER ASSEMBLY FOR JEWELRY

(75) Inventor: Joy Mangano, St. James, NY (US)

(73) Assignee: Ingenious Designs LLC, Edgewood, NY (US)

( * ) Notice: Subject to any disclaimer, the term of this patent is extended or adjusted under 35 U.S.C. 154(b) by 526 days.

(21) Appl. No.: 11/782,881

(22) Filed: Jul. 25, 2007

(65) Prior Publication Data

US 2009/0026158 A1 Jan. 29, 2009

(51) Int. Cl.

| | |
|---|---|
| ***B65D 21/02*** | (2006.01) |
| ***B65D 8/00*** | (2006.01) |
| ***A47F 7/02*** | (2006.01) |
| *B65D 85/62* | (2006.01) |

(52) U.S. Cl. ..... 220/4.27; 206/504; 206/581; 211/85.2; 220/4.26

(58) Field of Classification Search ..... 206/508, 206/509, 581; 211/85.2; 220/4.26, 4.27
See application file for complete search history.

(56) References Cited

U.S. PATENT DOCUMENTS

| | | | | |
|---|---|---|---|---|
| 1,190,203 | A | 7/1916 | Sorge | |
| 1,385,484 | A * | 7/1921 | Case | 220/4.27 |
| 2,077,219 | A * | 4/1937 | Conner | 215/6 |
| 2,514,573 | A * | 7/1950 | Harrison | 220/4.24 |
| 2,678,861 | A * | 5/1954 | Funk | 312/9.52 |
| 2,997,199 | A * | 8/1961 | Reachi | 220/23.86 |
| 3,067,896 | A * | 12/1962 | Berg et al. | 215/12.1 |
| 3,144,152 | A * | 8/1964 | Kopp | 215/6 |
| 3,217,915 | A * | 11/1965 | Weygandt | 215/10 |
| 3,273,739 | A * | 9/1966 | Wei | 220/4.27 |
| 3,369,691 | A * | 2/1968 | Wei | 220/4.27 |
| 3,441,033 | A * | 4/1969 | Flax | 132/295 |
| 3,442,414 | A * | 5/1969 | Pelli | 220/324 |
| 3,719,272 | A * | 3/1973 | Bodine et al. | 206/701 |
| 3,942,632 | A | 3/1976 | Witkoff | |
| 4,127,211 | A * | 11/1978 | Zerbey | 220/212 |
| 4,165,815 | A * | 8/1979 | Vetter | 220/4.27 |
| 4,239,308 | A | 12/1980 | Bradley | |
| 4,282,975 | A | 8/1981 | Ovadia | |
| 4,444,324 | A * | 4/1984 | Grenell | 215/6 |
| 4,804,101 | A * | 2/1989 | Heath | 220/504 |
| 4,807,773 | A * | 2/1989 | Tsai | 220/4.27 |
| 5,072,850 | A * | 12/1991 | Gagnon et al. | 220/300 |
| D350,460 | S * | 9/1994 | Picozza et al. | D7/629 |
| 5,363,977 | A * | 11/1994 | Hoff | 220/4.27 |
| 5,409,128 | A | 4/1995 | Mitchell | |

(Continued)

*Primary Examiner*—Anthony Stashick
*Assistant Examiner*—Ned A Walker
(74) *Attorney, Agent, or Firm*—Kenyon & Kenyon LLP

(57) ABSTRACT

A stacking tower assembly for displaying, storing, and transporting jewelry includes a lower stacking unit, an intermediate stacking unit, and a cover stacking unit. The lower stacking unit has a bottom wall, a continuous side wall, and a recess located on an inner surface of the continuous side wall. The walls forming a first storage compartment. The intermediate stacking unit has a bottom wall, a continuous side wall, a recess located on an inner surface of the continuous side wall, and a flange having a locking element extending from the bottom wall. The walls of the intermediate stacking unit forming a second storage compartment. The cover stacking unit has a top wall and a flange having a locking element extending from the top wall. The lower stacking unit, the intermediate stacking unit, and the cover stacking unit being detachably connected to form a unitary structure.

6 Claims, 8 Drawing Sheets

U.S. PATENT DOCUMENTS 5,511,653 A 4/1996 Ovadia
5,542,206 A * 8/1996 Lisch ..... 43/54.1
5,573,133 A * 11/1996 Park ..... 220/4.27
5,671,856 A 9/1997 Lisch
6,070,749 A * 6/2000 Joulia ..... 220/4.22
D455,550 S 4/2002 Wolf
6,378,533 B1 * 4/2002 Roman ..... 132/295
D474,021 S 5/2003 Lenaerts
D480,211 S 10/2003 Wolf
D518,336 S * 4/2006 Hirani ..... D7/629
7,047,983 B2 * 5/2006 Manougian et al. ..... 132/294
7,226,227 B2 * 6/2007 Gueret ..... 401/18
D581,597 S * 11/2008 Martinez ..... D28/82
2003/0150857 A1 * 8/2003 Tsai ..... 220/4.27
2006/0186019 A1 * 8/2006 Lu ..... 206/581
2007/0012693 A1 * 1/2007 Kummer ..... 220/4.27
2007/0084863 A1 * 4/2007 Mendez ..... 220/4.27

* cited by examiner

STACKING TOWER ASSEMBLY FOR JEWELRY

TECHNICAL FIELD

The present application relates to a stacking tower assembly configured for displaying, storing, and transporting jewelry.

BACKGROUND OF INVENTION

Numerous stackable containers have been developed for storing various items including jewelry.

For example, U.S. Pat. No. 1,190,203 to Sorge discloses a stackable box comprised of a plurality of units. In this disclosure, the units are connected to one another by interfacing male and female joints with one another.

In another example, U.S. Pat. No. 3,942,632 to Witkoff shows a stackable jewelry box comprising a case and a cover which can be assembled in a closed condition to form a cube or rectangular prism. In a closed condition the case has a top forwardly and downwardly slanting top socket carrying a forwardly and downwardly slanting pad slit to receive part of a piece of jewelry such as a ring. The cover has a downwardly and forwardly slanting underside to match the top of the case and pad. In a closed condition, with the cover on the case, the box is the shape of a cube or a rectangular prism. The cover can be taken off and fitted to the underside of the case with the front of the cover flush with the rear of the case. Thus, the exposed pad at the top of the case slants downwardly and forwardly at a greater angle than when the cover is on top of the case for better display of the jewelry.

Other examples of stackable containers, including jewelry boxes, include U.S. Pat. No. 5,409,128 to Mitchell, U.S. Pat. No. 4,282,975 to Ovadia, U.S. Pat. No. 5,511,653 to Ovadia, U.S. Design Pat. No. D474,021 to Lenaerts, U.S. Design Pat. No. D480,211 to Wolf, and U.S. Design Pat. No. D455,550 to Wolf.

These previously known stackable containers have drawbacks. For example, these containers have aesthetic, operational, storage, and travel limitations.

Accordingly it is an object of the present application to provide a stacking tower assembly that is suitable for display, storage, and which can be used in transit.

A further object of the invention is to provide a stacking tower assembly with a locking assembly sufficient to prevent accidental disassembly of adjacent stacking units from one another.

Thus, there is a need for an improved stacking tower assembly suitable for display, storage, and transport of jewelry.

BRIEF DESCRIPTION

The present application relates to a stacking tower assembly configured for displaying, storing, and transporting jewelry.

In accordance with certain embodiments of the present invention, a stacking tower assembly for displaying, storing, and transporting jewelry includes a lower stacking unit having a bottom wall, a continuous side wall, and a recess located on an inner surface of the continuous side wall. The walls form a first storage compartment. At least one intermediate stacking unit has a bottom wall, a continuous side wall, a recess located on an inner surface of the continuous side wall, and a flange having a locking element may extend from the bottom wall. The walls of the intermediate stacking unit form a second storage compartment. A cover stacking unit having a top wall and a flange having a locking element can extend from the top wall. The lower stacking unit, the at least one intermediate stacking unit, and the cover stacking unit are detachably connected to form a unitary structure.

In accordance with other embodiments of the present invention, a stacking tower assembly for displaying, storing, and transporting jewelry includes a lower stacking unit having a bottom wall, a continuous side wall, and an L-shaped recess located on an inner surface of the continuous side wall. The walls form a first storage compartment. At least one intermediate stacking unit having a bottom wall, a continuous side wall, a L-shaped recess located on an inner surface of the continuous side wall, and a flange having a rectangular shaped tab can extend from the bottom wall. The walls of the intermediate stacking unit form a second storage compartment. A cover stacking unit having a top wall and a flange having a rectangular shaped tab can extend from the top wall. The lower stacking unit, the at least one intermediate stacking unit, and the cover stacking unit are detachably connected to form a unitary structure.

In accordance with still other embodiments of the present invention, a stacking tower assembly for storing and transporting jewelry includes a lower stacking unit having a bottom wall, a continuous side wall, and a L-shaped recess located on an inner surface of the continuous side wall. The walls form a first storage compartment. At least one intermediate stacking unit having a bottom wall, a continuous side wall, a L-shaped recess located on an inner surface of the continuous side wall, and a flange having a rectangular shaped tab can extend from the bottom wall. The walls of the intermediate stacking unit form a second storage compartment. A cover stacking unit having a top wall and a flange having a rectangular shaped tab may extend from the top wall. The lower stacking unit, the at least one intermediate stacking unit, and the cover stacking unit are detachably connected to form a unitary structure. The lower stacking unit and the at least one intermediate stacking unit may be detachably connected with one another by twisting and untwisting one of the intermediate stacking unit and the lower stacking unit so that the locking element of the intermediate unit engages and disengages from the recess of the lower stacking unit. The at least one intermediate stacking unit and the cover stacking unit may be detachably connected with one another by twisting and untwisting one of the intermediate stacking unit and the cover stacking unit so that the locking element of the cover stacking unit engages and disengages from the recess of the intermediate stacking unit.

The invention may be embodied by numerous other devices and methods. The description provided herein, when taken in conjunction with the annexed drawings, discloses examples of the invention. Other embodiments, which incorporate some or all steps as taught herein, are also possible.

DETAILED DESCRIPTION

The present application relates to a stacking tower assembly configured for displaying, storing, and transporting jewelry.

Figure 1:
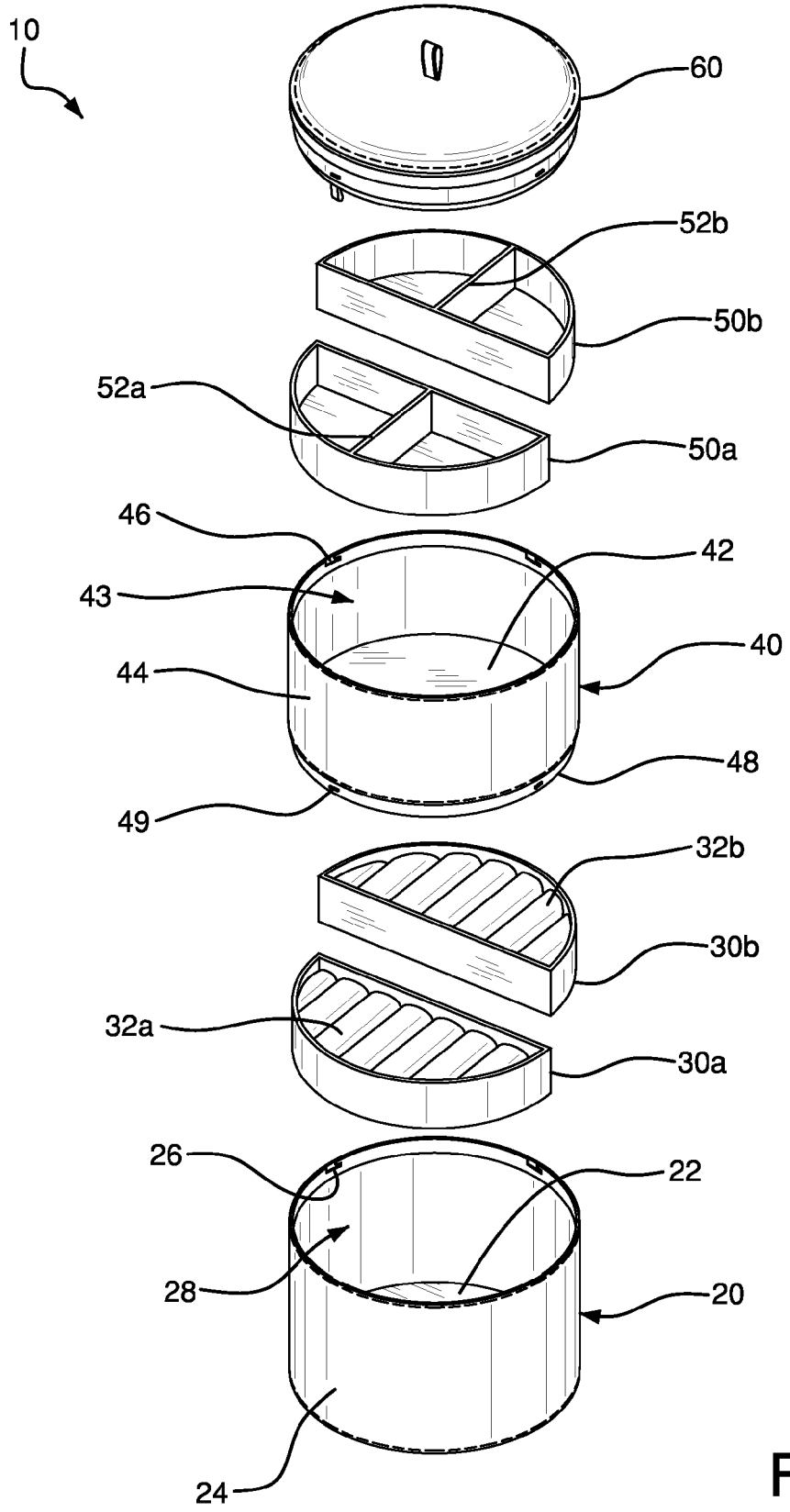
FIG. 1 shows an exploded view of a stacking tower assembly as may be employed in accordance with certain embodiments of the present invention.

FIG. 1 shows an exploded view of a stacking tower assembly 10 as may be employed in accordance with certain embodiments of the present invention. In the example, the stacking tower assembly 10 includes a lower stacking unit 20, a pair of semi-circular inserts 30*a, b* with jewelry holders 32*a, b*, an intermediate stacking unit 40, a pair of semi-circular inserts 50*a, b* with partitions 52*a, b* forming separate compartments for storing jewelry, and a cover stacking unit 60.

Figure 2:
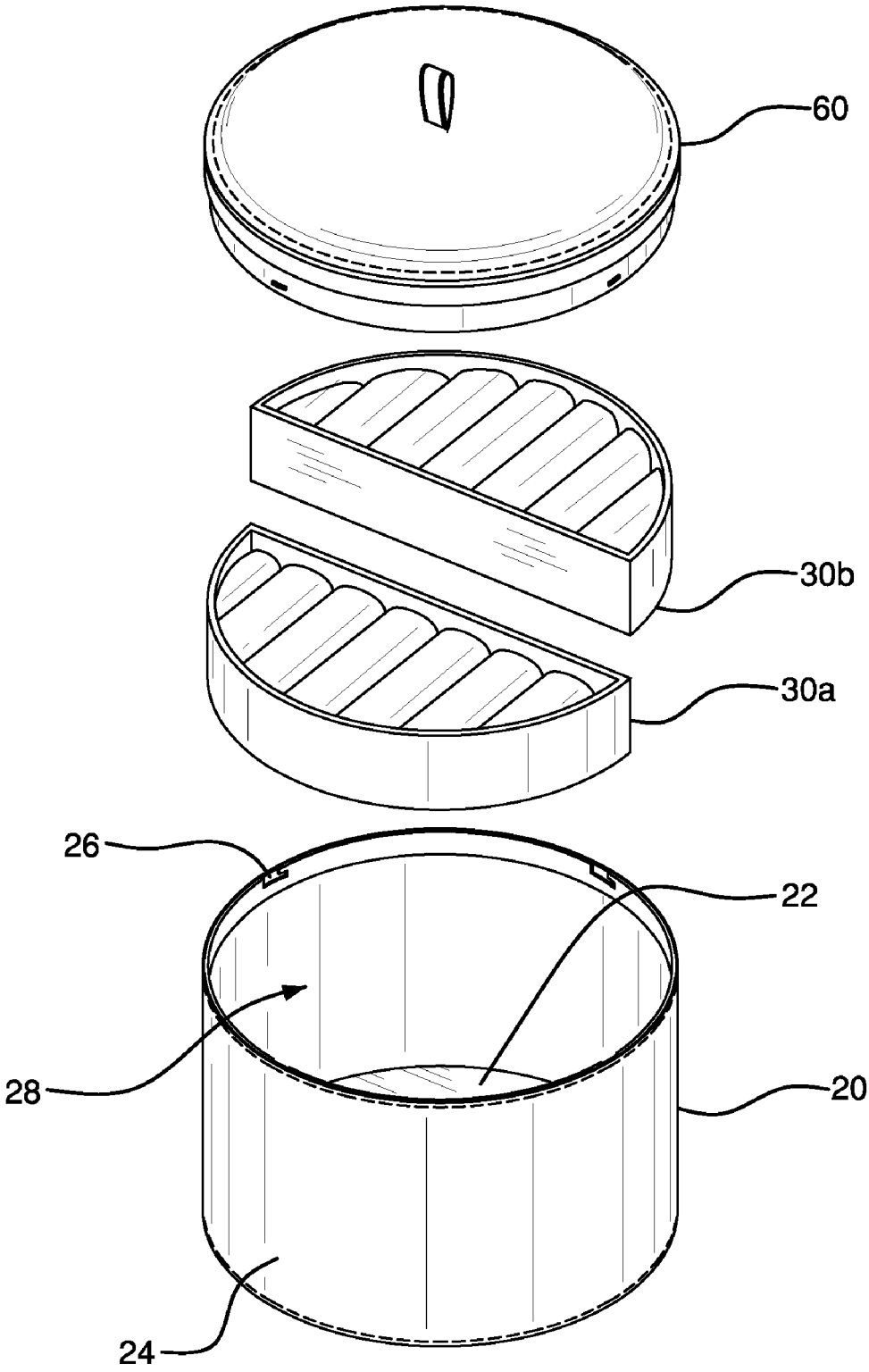
FIG. 2 shows an exploded view of a lower stacking unit and cover stacking unit as may be employed with certain embodiments of the present invention.

As can be seen in FIGS. 1-2, the lower stacking unit 20 has a bottom wall 22, a continuous side wall 24, and a recess 26 located on an inner surface of the continuous side wall 24. The walls 22, 24 form a storage compartment 28, in this case, for receiving the pair of semi-circular inserts 30*a, b*. In the example, the lower stacking unit 20 is circular shaped and the recess 26 is L-shaped. In the examples shown, four recesses 26 are spaced equidistant around the inner surface of the side wall 24; however, any number of recesses may used. The storage compartment 28 may be lined with any material which can prevent jewelry from being damaged, for example, felt may be used.

Turning to FIG. 2, this example shows that the lower stacking unit 20 may be used with just the cover stacking unit 60 and optionally with the inserts 30*a, b*. This arrangement may be suitable for transporting jewelry such as during travel. For example, the lower stacking unit 20 and cover stacking unit 60 may be stored and transported in luggage.

Referring again to FIG. 1, the intermediate stacking unit 40 is shown having a bottom wall 42 and a continuous side wall 44. The walls 42, 44 form a storage compartment 43, in this case, for receiving the pair of semi-circular inserts 50*a, b*. A recess 46 may be located on an inner surface of the continuous side wall 44 and a flange 48, having a locking element 49, may extend from the bottom wall 42. In this example, the flange 48 extends downwardly from the bottom wall 42. The locking element 49 located on the flange 48 may be a rectangular shaped tab. In the examples shown, four tabs spaced equidistant around the flange are shown; however, any number of tabs may used. In the example, the intermediate stacking unit 40 is circular shaped and the recess 46 is L-shaped. In the examples shown, four recesses are spaced equidistant around the inner surface of the side wall; however, any number of recesses may used. The storage compartment 43 may be lined with any material which can protect jewelry from being damaged.

Figure 3:
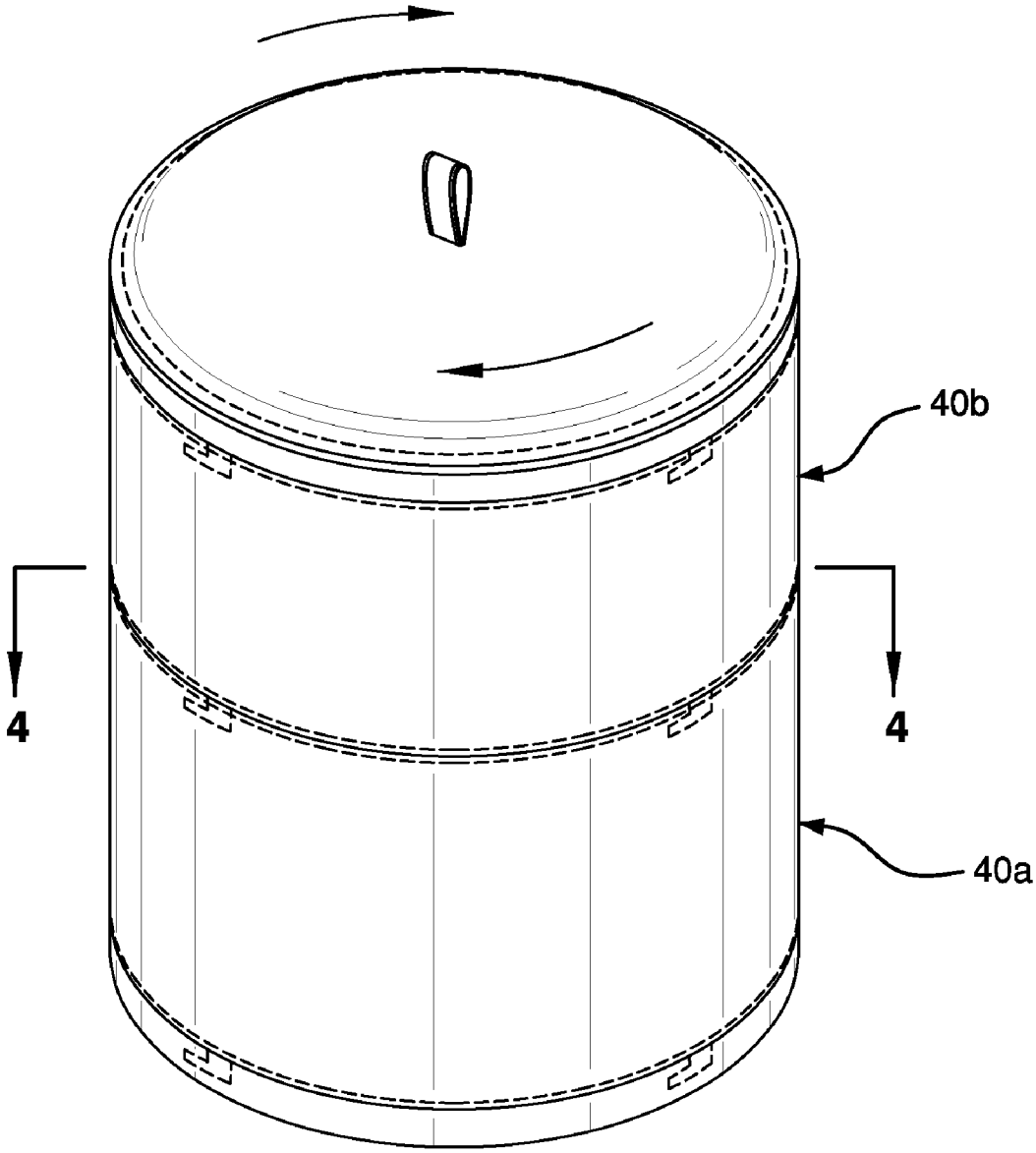
FIG. 3 shows a elevational view of two intermediate stacking units being detachably connected in accordance with certain embodiments of the present invention.
Figure 4:
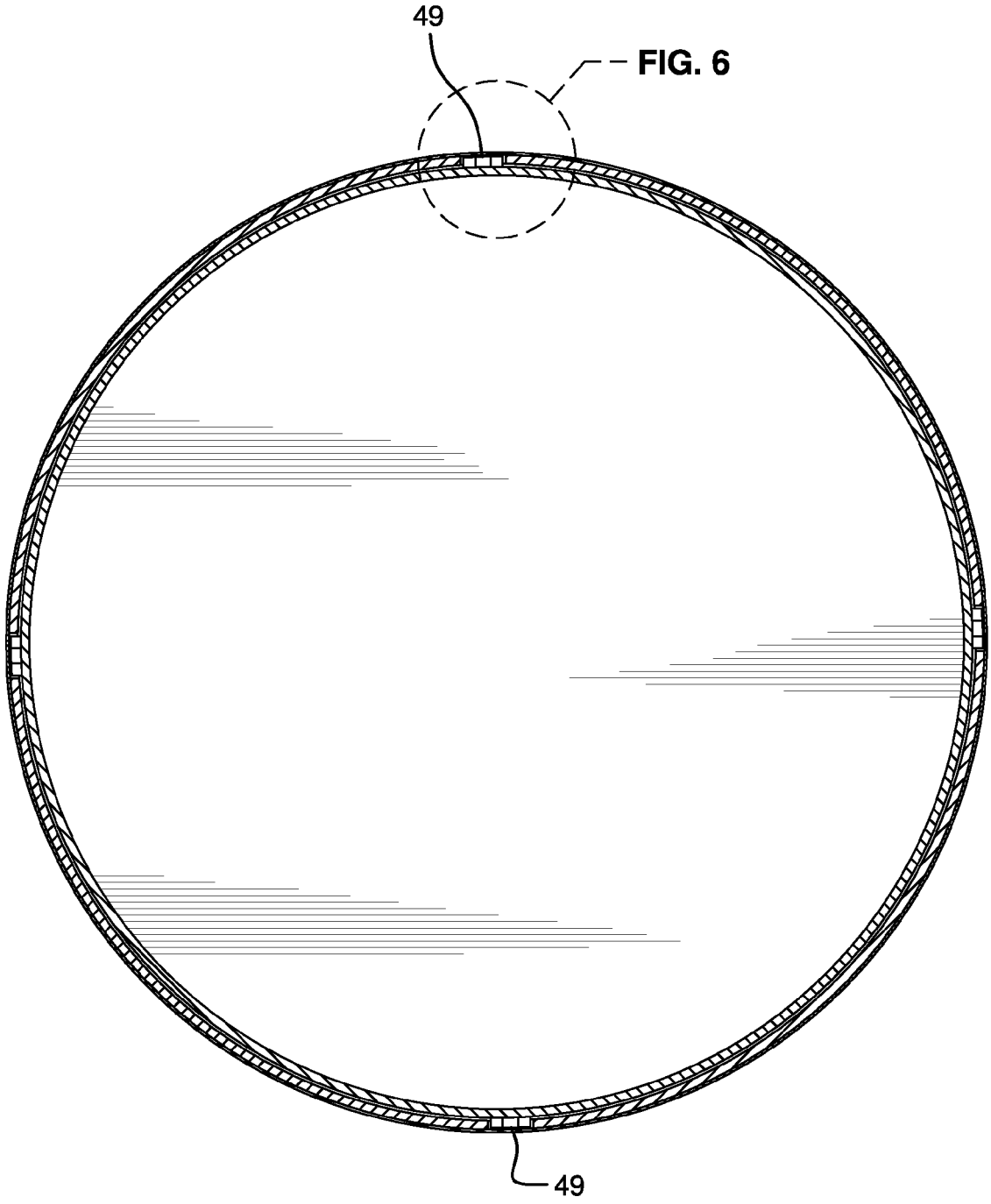
FIGS. 4-6 show various views of a locking assembly as may be employed with certain embodiments of the present invention.

FIG. 3 shows an example in which a plurality of intermediate stacking units 40*a, b* are detachably connected with one another; however, it is contemplated by certain embodiments of the invention that any number of intermediate stacking units 40*a, b* may be used.

FIGS. 4-9 show a locking assembly as may be employed with certain embodiments of the present invention. In these examples, a locking element 49 of one intermediate stacking unit 40*a* is shown engaging and disengaging from a recess 46 of another intermediate stacking unit 40*b* (See FIGS. 5-6). As discussed herein, other arrangements may be used. The locking element 49 and recess 46 combine to form what is referred to as a locking assembly in portions of the specification.

Using the locking assembly illustrated, the lower stacking unit 20, the intermediate stacking unit 40, and the cover stacking unit 60 can be detachably connected in various combinations to form a unitary structure.

Figure 5:
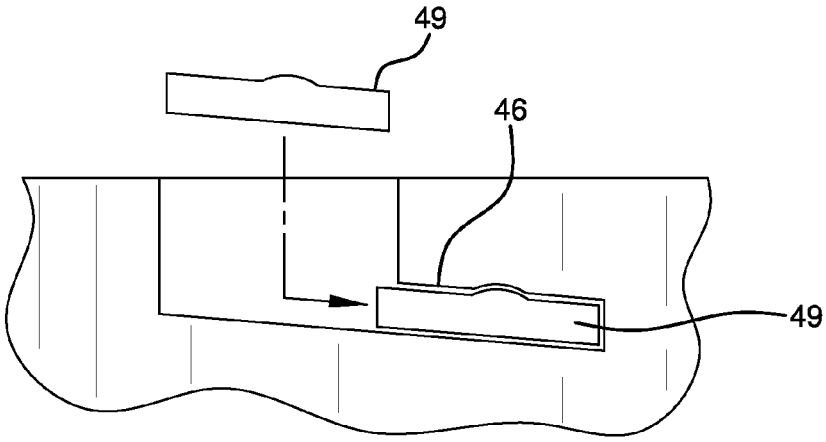
Figure 6:
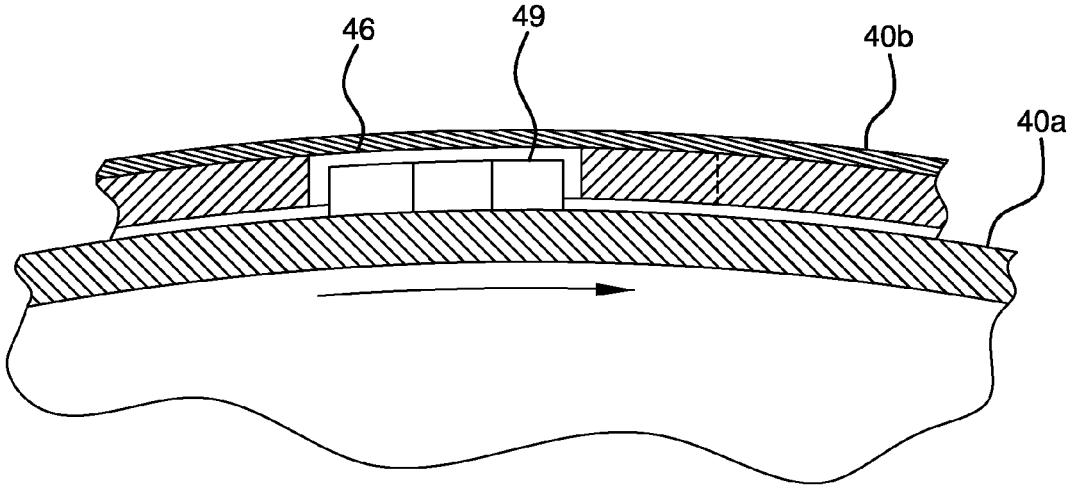
Figure 7:
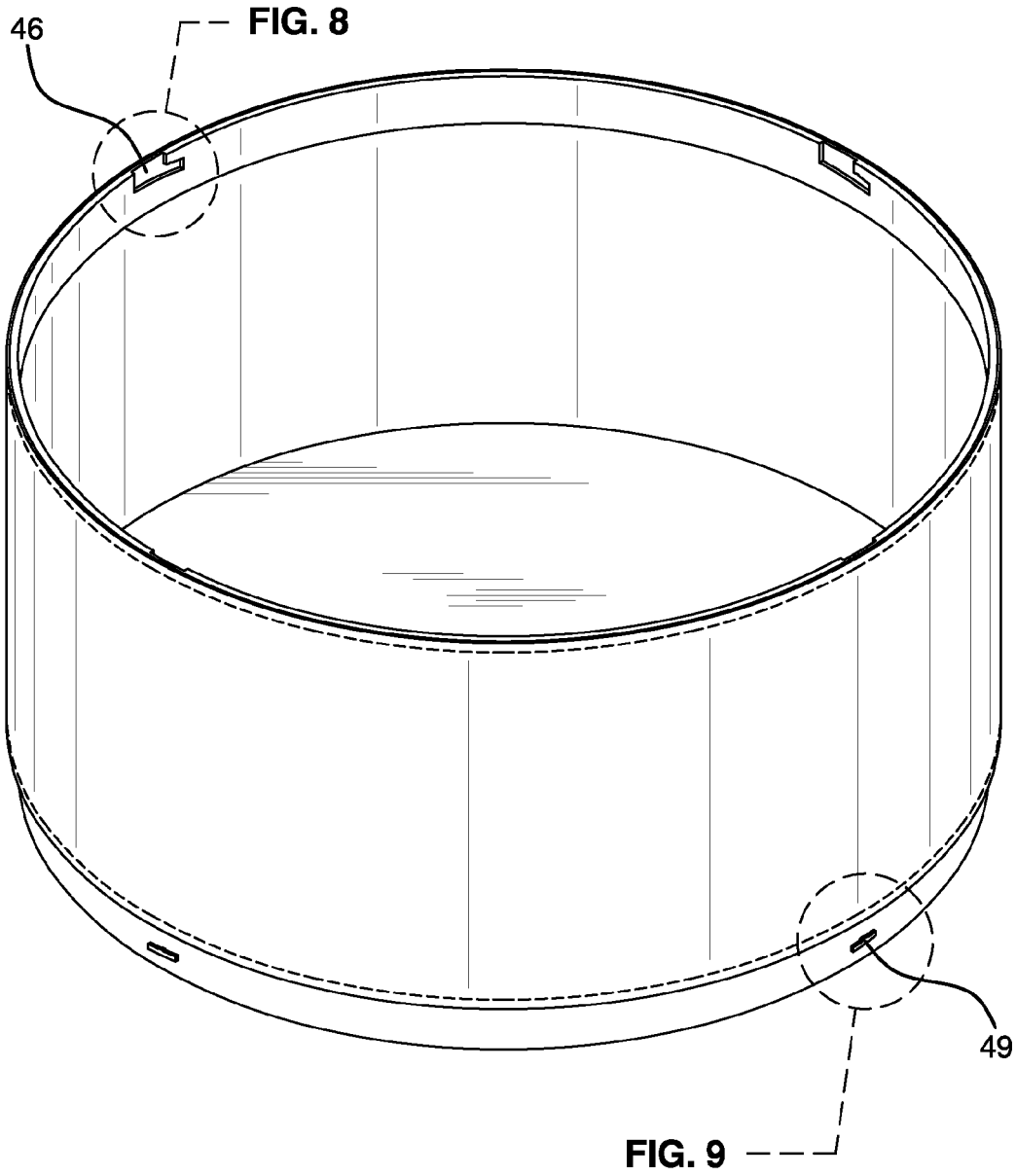
FIG. 7 shows an elevational view of an intermediate stacking unit as may be employed with certain embodiments of the present invention.

As seen in FIGS. 5 and 7, to lock one stacking unit with another, the locking element 49 on one stacking unit can be detachably connected with a recess 46 on another stacking unit by twisting and untwisting either of the stacking units clockwise or counterclockwise. One of the stacking units is twisted or untwisted so that the locking element 49 on the upper stacking unit engages and disengages from the recess 46 on the lower stacking unit.

For example, as shown in FIG. 1, the intermediate stacking unit 40 may be placed on top of the lower stacking unit 20 and twisted so that the locking element 49 of the intermediate stacking unit 40 engages with the recess 26 of the lower stacking unit 20 to connect the stacking units with one another.

Figure 8:
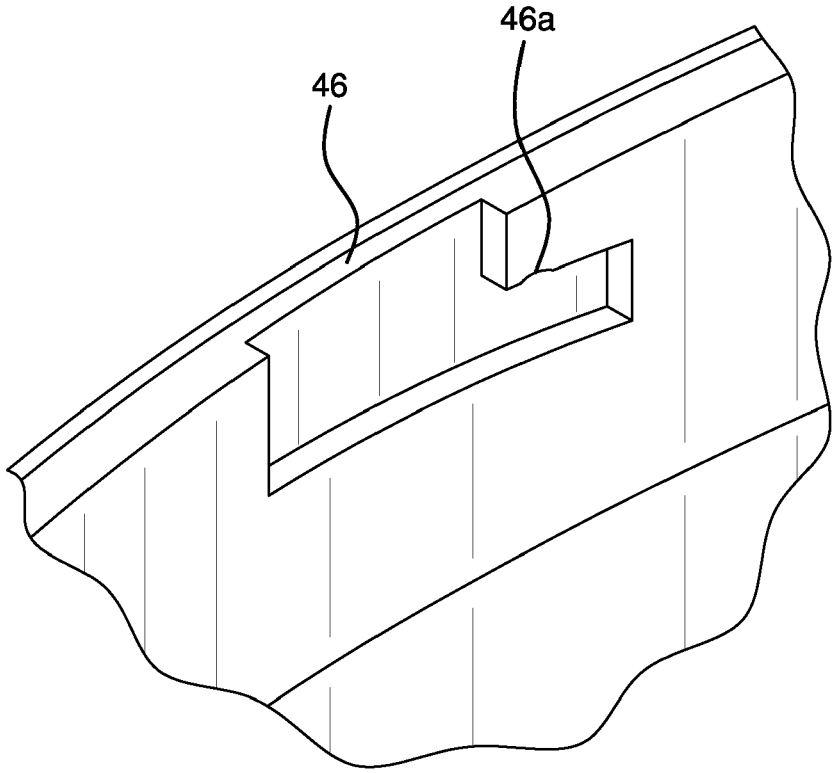
FIGS. 8-9 show exploded views of the locking assembly of FIG. 7.
Figure 9:
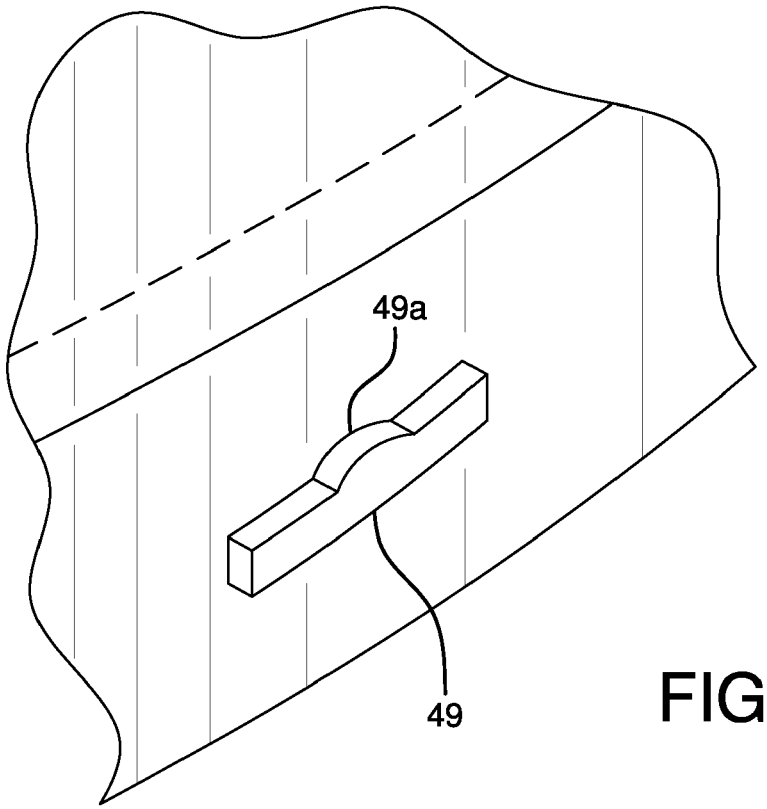

As seen in FIGS. 8-9, it can be seen that the recess 46 may be L-shaped and may also include a notch 46*a* for receiving a protrusion 49*a* located on the rectangular shaped locking element 49 to further secure the stacking units with one another.

Figure 10:
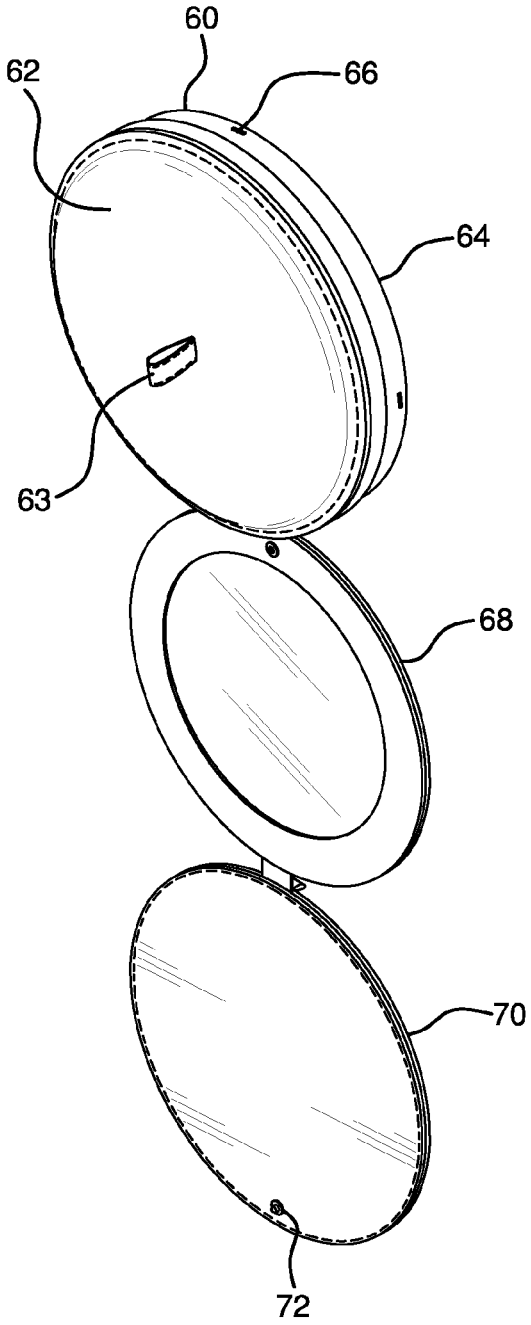
FIGS. 10-11 show top and bottom views of the cover stacking unit as may be employed in accordance with certain embodiments of the present invention.
Figure 11:
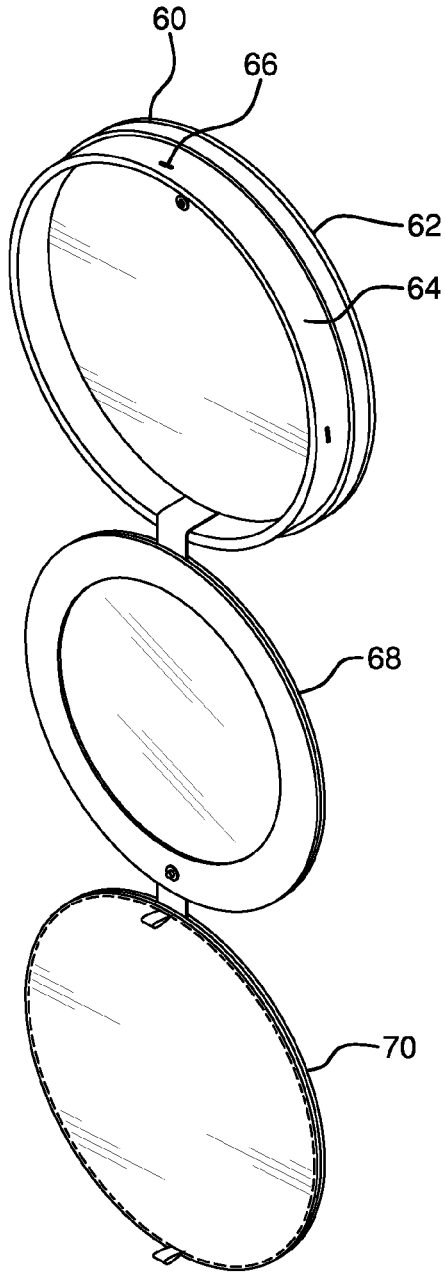

FIGS. 10-11 show top and bottom views of the cover stacking unit 60. The cover stacking unit 60 has a top wall 62 and a flange 64 having a locking element 66 extending from the top wall 62.

The top wall 62 may include a handle 63. In the examples, the cover stacking unit 60 is circular shaped and the locking elements 66 are rectangular shaped. In the examples shown, four locking elements 66 are spaced equidistant around the outer surface of the flange 64; however, any number of locking elements 66 may used.

The cover stacking unit 60 may also include a mirror 68, such as a double-sided mirror. In addition, a protective member 70 may be connected to the mirror. In the examples shown, the protective member 70 is connected to the mirror 68 via a snap fastener 72. The protective member 70 may limit damage to the mirror 68 during display, storage, and transport of the stacking tower assembly 10 or portions thereof.

In certain embodiments of the present invention, the lower or intermediate stacking units 20, 40 can be detachably connected with the cover stacking unit 60 by twisting and untwisting one of the lower and intermediate stacking units 20, 40 and the cover stacking unit 60 so that the locking element 66 of the cover stacking unit 60 engages and disengages from the recesses 26, 46 of the lower and intermediate stacking units 20, 40, respectively.

While the present invention is described with respect to particular examples and preferred embodiments, it is understood that the present invention is not limited to these examples and embodiments. The present invention as claimed therefore includes variations from the particular examples and preferred embodiments described herein, as will be apparent to one of skill in the art.

What is claimed is:

1. A stacking tower assembly for displaying, storing, and transporting jewelry, comprising:

a lower stacking unit having a bottom wall, a continuous side wall, and an L-shaped recess located on an inner surface of the continuous side wall, the walls forming a first storage compartment;

at least one intermediate stacking unit having a bottom wall, a continuous side wall, an L-shaped recess located on an inner surface of the continuous side wall, and a flange having a rectangular shaped tab extending from the bottom wall, the walls of the intermediate stacking unit forming a second storage compartment; and a cover stacking unit having a top wall and a flange having rectangular shaped tab extending from the top wall, wherein the lower stacking unit, the at least one intermediate stacking unit, and the cover stacking unit being detachably connected to form a unitary structure, the lower stacking unit and the at least one intermediate stacking unit being detachably connected with one another by twisting and untwisting one of the lower stacking unit and the intermediate stacking unit so that the locking element of the intermediate stacking unit engages and disengages from the recess of the lower stacking unit, and the at least one intermediate stacking unit and the cover stacking unit being detachably connected with one another by twisting and untwisting the cover stacking unit and the intermediate stacking unit so that the locking element of the cover stacking unit engages and disengages from the recess of the intermediate stacking unit, wherein the cover stacking unit further comprises a double-sided mirror having a front mirror surface on a first side and a rear mirror surface on a second side, and a protective member having a first snap fastener, and wherein the second side of the double-sided mirror and the protective member are connected by the first snap fastener, and the first side of the double-sided mirror and an undersurface of the cover stacking unit are connected by a second snap fastener.

2. The stacking tower assembly of claim 1, wherein a circular unitary structure is formed.

3. The stacking tower assembly of claim 1, wherein the storage compartments are lined.

4. The stacking tower assembly of claim 1, further comprising at least one insert being positionable within the storage compartments.

5. The stacking tower assembly of claim 1, wherein a plurality of recesses are formed on each respective stacking unit.

6. The stacking tower assembly of claim 1, wherein a plurality of locking elements are formed on each respective unit stacking unit.

* * * * *